US005709325A

United States Patent [19]

Renault et al.

[11] Patent Number: 5,709,325

[45] Date of Patent: Jan. 20, 1998

[54] MANUAL PRECOMPRESSION PUMP FOR SPRAYING A LIQUID, AND DISPENSING ASSEMBLY EQUIPPED WITH SUCH A PUMP

[75] Inventors: Philippe Renault, Chaville, France; Guiseppe Dalsant, Baselga Di Pine; Adalberto Geier, Villazzono, both of Italy

[73] Assignee: L'Oreal, Paris, France

[21] Appl. No.: 562,626

[22] Filed: Nov. 24, 1995

[30] Foreign Application Priority Data

Nov. 23, 1994 [FR] France ..... 94 14036

[51] Int. Cl.[6] ..... B67D 5/40

[52] U.S. Cl. ..... 222/383.1

[58] Field of Search ..... 222/379, 380, 222/382, 383.1, 385, 481.5, 484, 341; 237/329.333

[56] References Cited

U.S. PATENT DOCUMENTS

| | | | |
|---|---|---|---|
| 3,337,096 | 8/1967 | Brown | 222/380 |
| 3,489,322 | 1/1970 | Ayres | 222/380 |
| 5,125,545 | 6/1992 | Passalacqua | 222/383.1 |
| 5,192,006 | 3/1993 | Van Brocklin et al. . | |
| 5,425,476 | 6/1995 | Montaner et al. | 222/383.1 |

FOREIGN PATENT DOCUMENTS

| | | | |
|---|---|---|---|
| 161560 | 3/1955 | Australia | 222/380 |
| 2 634 825 | 2/1990 | France . | |
| 405229577 | 9/1993 | Japan | 222/383.1 |

*Primary Examiner*—Philippe Derakshani
*Attorney, Agent, or Firm*—Young & Thompson

[57] ABSTRACT

A precompression pump for spraying a liquid comprises a pumping chamber (502) containing a first piston (507) associated with an operating member (506), this piston bearing against a first spring (509); a precompression chamber (505) equipped with a second piston (510) bearing against a second spring (511), the precompression chamber communicating with the pumping chamber via a passage (550), so that their axes of symmetry being offset. A feed channel (504) equipped with a valve (504a, 515) emerges in the pumping chamber. A dispensing element (517) is equipped with a nozzle (520) and with a dispensing channel (518) connecting the nozzle to the precompression chamber, the latter including a device (F) for placing in communication and for closing the said passage (550), so that communication is interrupted in the position of rest of the pump and so that communication is established under the action of the operating member.

20 Claims, 2 Drawing Sheets

MANUAL PRECOMPRESSION PUMP FOR SPRAYING A LIQUID, AND DISPENSING ASSEMBLY EQUIPPED WITH SUCH A PUMP

FIELD OF THE INVENTION

The invention relates to a precompression pump for spraying a liquid, and especially a cosmetic product such as a hair lacquer, under pressure. The invention aims especially to provide a pump of this sort which can be actuated manually and is of reduced bulk, so that it can be housed in the covering cap of a liquid dispenser.

BACKGROUND OF THE INVENTION

It is known that the precompression of a liquid contained in the body of a pump is intended to ensure good spray quality, regardless of the means by which the pump is actuated, and it is therefore sought to obtain a sufficient degree of precompression. Furthermore, for the precompression to retain its full effectiveness, it is appropriate for the pressure drop, when liquid flows from the pumping chamber towards the spray nozzle, to be as low as possible.

EP-A-0,437,131, in the name of the assignee, makes known a manual precompression pump including, inter alia, a chamber for pumping the liquid in communication with a precompression chamber, a spray nozzle connected by a dispensing channel to the precompression chamber, and a feed channel equipped with a non-return valve emerging in the pumping chamber.

Precompression pumps of the sort of the one described in EP-A-0,437,131 would benefit from being improved from the spraying accuracy point of view, owing to the fact that this pump is actuated by pressing a push-button which at the same time includes the spray nozzle. As a consequence, it is difficult to target the point to which the spray is to be applied.

Furthermore, through its construction, this known pump is difficult to assemble. Indeed, given that all the constituent parts of this pump are aligned along one and the same axis of symmetry, its bulk in the axial sense is relatively large, which prevents it from being used in many embodiments employing a covering cap.

OBJECT OF THE INVENTION

The present invention aims to overcome the drawbacks of the prior art by making available to the user an assembly for dispensing a liquid which is of simple construction, the dispensing head of which is stationary and which includes a precompression pump, which is of small bulk and has a reduced number of parts and which, as a consequence, from the industrial point of view, is easy to assemble. In addition, the pressure drop has been minimized by comparison with the pump according to EP-A-0,437,131, so that the spray quality is improved. This results in a reduction in the particle size of the liquid leaving the nozzle.

SUMMARY OF THE INVENTION

More precisely, the present invention relates to a precompression pump for spraying a liquid under constant pressure, which comprises, in a known fashion:

a cylindrical body defining a cylindrical pumping chamber having an axis of revolution, and in which chamber there is housed a first piston associated with an operating member, this piston bearing against a first elastic return means;

a cylindrical precompression chamber having an axis of revolution and being equipped with a second piston bearing against a second elastic return means, it being possible for the precompression chamber to communicate with the pumping chamber via a passage;

a feed channel equipped with a non-return valve emerging in the pumping chamber;

a dispensing element equipped with a spray nozzle and with a dispensing channel connecting the nozzle to the precompression chamber, this precompression chamber including a sliding means for placing in communication and for closing the said passage, so that communication is interrupted in the position of rest of the pump and that communication is established upon precompression under the action of the operating member, the sliding means for placing into communication and for closure then freeing the passage between the precompression chamber and the pumping chamber. This pump is characterized in that the axis of the precompression chamber is offset with respect to the axis of the pumping chamber.

This pump is intended to be mounted on a container containing the liquid to be dispensed.

The first piston is also called the actuating piston, and the second piston the compression piston.

To make it easier to prime the pump before it is first used, a means may be provided causing the air inside the pump body, located between the first and second pistons, to be discharged. Advantageously, this means is a central stud formed at the top of the second piston, turned towards the pumping chamber; this stud can come to bear against the first piston when the operating member is actuated, that is to say, when the volume of the pumping chamber is at a minimum. Upon this actuation, a mechanical link is established between the two pistons, the first pushing the second into a position such that the air compressed in the pump body can escape via the precompression chamber and the dispensing channel.

According to another advantageous feature of the invention, the nozzle is stationary with respect to the pump body. This spray nozzle is equipped with a spray orifice pointing along an axis substantially orthogonal to the axis of symmetry which defines the precompression chamber.

Advantageously, the sliding means for placing in communication and for closing this pump consists, according to a first embodiment, of a projection, preferably frustoconical, formed at the top of the second piston. In the position of rest of the pump, the projection therefore closes the communication between the precompression chamber and the pumping chamber. Upon actuation of the pump, by pushing in the operating member against the first elastic return means, the pressure of the liquid inside the body of the pump will rise to a predetermined value and cause this placing in communication, by pushing the precompression member in opposition to the second elastic return means. It is clear that the predetermined value of precompression depends on the force developed by this second elastic return means.

Furthermore, a means for venting the container to atmosphere may be provided consisting, for example, of an air intake orifice pierced in the outer wall of the pump body, emerging in the lower part of the precompression chamber, that is to say in the part where the second elastic return means is situated, so as to balance the pressure prevailing in the container with the pressure outside. Advantageously, when the pump is at rest, this venting to atmosphere is inoperative. To this end, a sealing means may be located between the air intake orifice and the container, closing off this orifice during storage periods and capable of allowing an amount of air into the container during the dispensing of a respective amount of liquid.

Thus, a first sealing lip of annular shape is borne by the second piston, situated in a zone between the dispensing channel and the air intake orifice.

Advantageously, this means for sealing between the air intake orifice and the container is a second annular lip borne by the precompression piston, which lip is located inside the precompression chamber. This second lip is placed at a level situated between the first lip and the container.

According to a beneficial aspect, the precompression chamber is equipped with a flared zone situated at the lower end of this precompression chamber, on the container side, between the second sealing lip when it is in its position of rest, and an end face which separates the precompression chamber from the container.

Advantageously, to make it easier to vent the container to atmosphere, an orifice is provided between the precompression chamber and the container. Preferably, this orifice is a capillary orifice, made in the form of a cylindrical tube through which a capillary channel passes. It is interesting to note that the function of the capillary channel is to prevent the liquid from the container from penetrating the lower part of the precompression chamber, on the second return means side. This provision is all the more useful if the liquid to be dispensed is a composition liable to dry out or clog the precompression piston, such as a hair lacquer or paint for example.

Thus, upon actuation of the pump, the second sealing lip of the precompression piston is no longer in contact with the internal wall of the precompression chamber, and air coming from the air intake orifice may, via the capillary channel, penetrate the precompression chamber and the container so as to replace with air an equivalent volume of liquid dispensed.

According to a second embodiment of the invention, the sliding means for placing in communication and for closing the pump may consist of an annular sealing ring firmly secured to the second piston and facing the first piston, and bearing against an edge or peripheral groove of the passage between the precompression chamber and the pumping chamber, capable of closing off this passage.

Advantageously, the first elastic return means, housed in the pumping chamber, consists of a helical spring, preferably made of metal. The second elastic return means preferably also consists of a metal helical spring. As explained earlier, by selecting a spring with a greater or lesser spring rate, it is possible to influence the force required to bring about the dispensing of the liquid.

The non-return valve which prevents the liquid accumulated in the pumping chamber from dropping back down into the container preferably includes a spherical ball housed in a frustoconical portion of the feed channel. This channel communicates with the liquid contained in a container by means of a dip tube.

This pump can be used for spraying a number of liquids, such as, for example, a cosmetic composition, especially a hair lacquer, a body spray, a dermatological lotion, or a pharmaceutical composition.

The invention also relates to an assembly for dispensing a liquid in the form of droplets, including the container for the liquid to be dispensed, surmounted by a precompression pump in accordance with the features which have just been described.

A means may be provided for fixing the pump onto the container containing the liquid to be sprayed. This fixing means includes, for example, a disc-shaped element, extending radially to the pump body and including a peripheral part shaped into a cylindrical skirt equipped on the inside with a snap bead, able to interact with a complementary annular groove produced on a neck with which the container is equipped. The container may furthermore include a covering cap, fixed onto the container, this cap surrounding the pump mounted on this container.

According to a preferred embodiment of the present invention, the member for operating the pump is actuated by means of a lever arm, articulated to one wall of the covering cap. This arrangement allows the user to spray the liquid accurately under good conditions, while applying, during actuation, a force which is smaller than that required for the pump of the prior art.

Two embodiments of the present invention will now be described purely by way of non-limiting illustration, with reference to the appended drawings.

Figure 1:
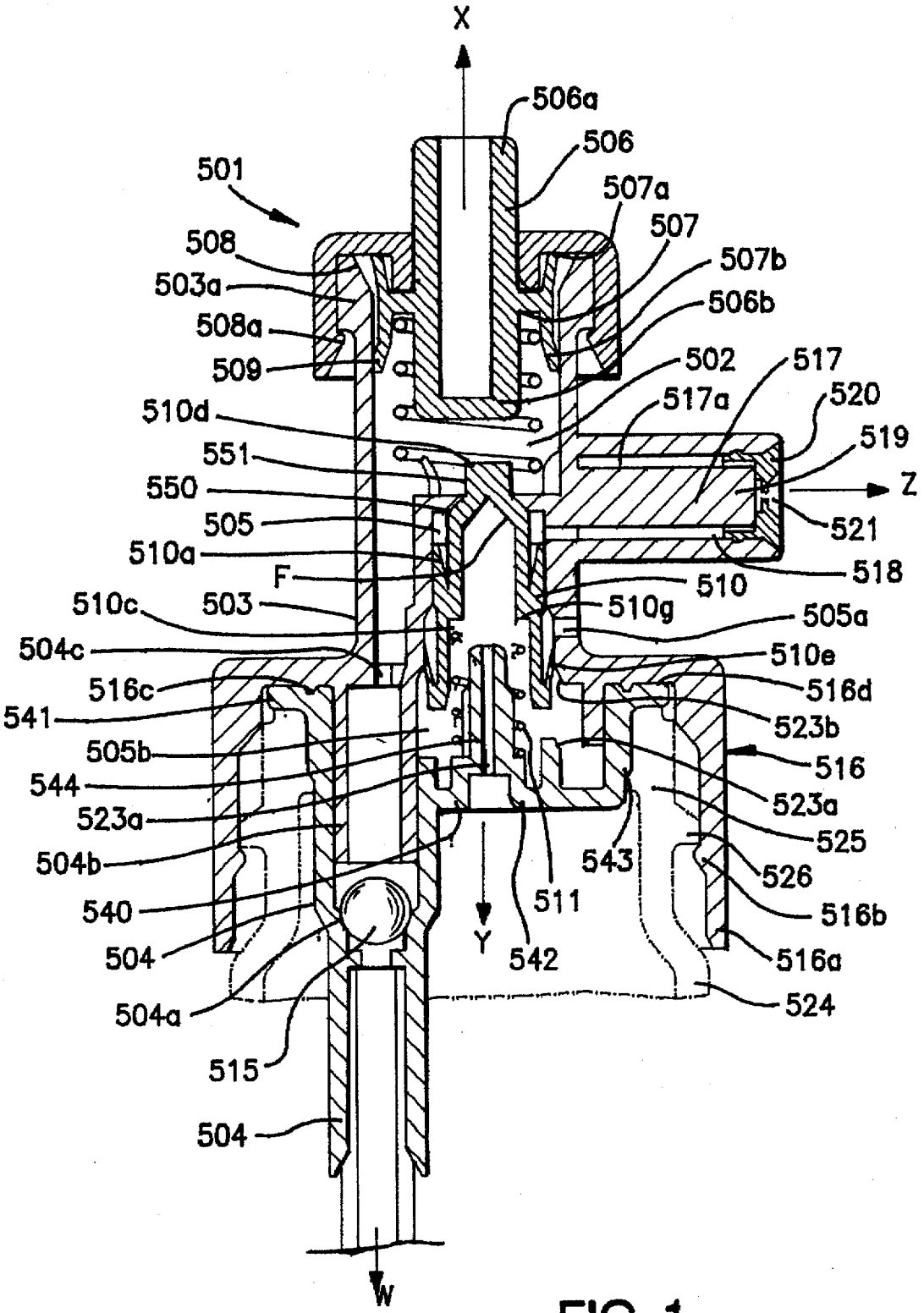
FIG. 1 is an axial section through a precompression pump according to a first embodiment of the invention.

Referring to the drawings, especially to FIG. 1, a precompression pump 501 has been represented for spraying a liquid, such as a hair lacquer, contained in a container 524 surmounted by a cylindrical neck 525 equipped with an external snap bead 526.

The pump 501 comprises a body 503, generally cylindrical, intended to be fixed on the neck 525 of the container. Fixing is by means of a snap ring 516 consisting of a cylindrical skirt **516*a* bearing an annular rib 516*b* on the inside, able to interact with the bead 526 on the neck. The skirt 516*a* joins onto the periphery of a disc-shaped element 516*d*, itself extending radially from the pump body 503. This disc-shaped element 516*d* includes, on the side turned towards the container, an annular rib 516*c* bearing against an annular rim 541 of a cup 540 bent radially outwards. The rim 541 is sandwiched between the disc-shaped element 516*d* of the snap ring 516 and the neck 525** of the container.

The pump body 503 forms, at its end furthest from the container, a cylindrical pumping chamber 502 having a central axis of revolution X, in which chamber there is housed a helical compression spring 509, generally made of metal, which bears against a first piston 507. This piston 507 is connected to a cylindrical operating member 506 including an emerging end **506*a*** serving to actuate the pump.

On the side turned towards the container, this first piston 507 includes an extension **506*b* inserted inside the turns of the spring 509. The piston 507 furthermore includes two annular sealing lips pressing against the internal wall of the body 503, a first 507*a* of which lips is turned to the emerging end side 506*a*, while the second 507*b*** of these lips is turned in the opposite direction.

The assembly formed by the piston 507 and the operating member 506 is held in place by a fixing cup 508, including an internal snap bead **508*a*, this bead interacting with an annular bulge 503*a* with which the free end 503*b* of the body 503 is equipped. The cup 508 includes, on its side turned towards the container, a cylindrical skirt 508*a* serving to guide the operating member 506** in sliding.

The pump body 503 is connected in its middle zone to a cylindrical extension 517 which is a body of revolution about an axis Z substantially perpendicular to the central axis X, this extension constituting a dispensing element. The dispensing element 517 includes an annular recess **517*a* which leads towards a dispensing channel 518 parallel to the axis Z, this channel leading towards a precompression chamber 505** having an axis of revolution Y. The axis Y is parallel to but spaced from the axis X and orthogonal to the axis Z.

The annular recess **517*a* defines a central stud 519, on the end of which there is fixed a spray nozzle 520 equipped with a central orifice 521**. It is of course possible to vary the angle formed between the axes X and Z by choosing an angle which may, for example, range from approximately 45° to approximately 135° depending on the anticipated use.

On the side turned towards the container, the pumping chamber 502 is extended by a cylindrical bore, the diameter of which is small by comparison with the diameter of the pumping chamber 502, forming the precompression chamber 505 delimited by a cylindrical wall 505*b*. The precompression chamber has said axis Y parallel to the axis X, the axes X and Y, as mentioned, being offset. The zone of transition between the pumping chamber and the precompression chamber includes an annular restriction defining a passage 550, in the region of the nozzle 520.

Substantially above the level of the snap ring 516, the feed channel 518 communicates with the precompression chamber 505. In a zone situated between the channel 518 and the snap ring, the wall 505*b* of the precompression chamber is equipped with an air intake orifice 505*a*, the purpose of which will be explained later, during the description of the operation of the pump.

The precompression chamber 505 includes a precompression piston 510 of elongate cylindrical overall shape, able to slide in a sealed fashion in this chamber, and which is provided with two sealing lips 510*a*, 510*e*. The lip 510*e* is situated at a lower level than the lip 510*a*, with respect to the container 524. Moreover, the two lips have a free edge which is directed on the same side, towards the pumping chamber 502. The lip 510*a* prevents any communication between the air intake orifice 505*a* and the dispensing channel 518. The passage 550 between the pumping chamber 502 and the precompression chamber is formed by an internal radial projection against the edge of which there may bear, in the position of rest of the pump, a frustoconical projection 551 of the precompression piston, constituting a sliding means F for placing in communication and for closure, capable of closing off the passage 550 in the position of rest and of establishing communication, in the liquid-dispensing position, between the pumping chamber 502 and the precompression chamber 505. The lip 510*e* constitutes a means of temporary sealing between the outside and the container.

The precompression member 510, on the side turned towards the pumping chamber 502, bears a central stud 510*d* passing through the passage 550 and extending into the pumping chamber 502. Its purpose will be explained later.

The lower part 510*c* of the precompression piston 510, turned towards the container, bears on the turns of a second helical spring 511, constituting a second elastic return means, whose function is to push, in the position of rest, the precompression piston 510 into the position for closing the passage 550. This spring 511 butts up against an internal annular projection 510*g* borne by the precompression piston.

The cup 540 is engaged in the neck 525 of the container and has a cylindrical overall shape. It includes a cylindrical peripheral wall 543, bearing at its upper part, the aforementioned annular rim 541. The cup 540 is closed, on the opposite side to the rim, by an end face 542. This end includes, on the side turned towards the pumping chamber, an open shaft 544 through which a capillary channel 523*a*, having the same axis of symmetry (revolution) Y as the precompression piston, passes. The spring 511 surrounds the open shaft 544 and bears against the end 542.

This end 542 furthermore has a tube 504 passing through it, this tube fitting over a complementary tube 504*b* which is itself connected to the pumping chamber 502 by a liquid feed passage 504*c*. On the side turned towards the container, the tube 504 includes a tapered restriction zone in which there is located a ball 515 having a diameter which is intermediate between that of the feed channel and that of the restriction zone 504*a*, acting as a liquid inlet valve and preventing the liquid drawn into the pump body from dropping back down into the container 524. The restriction zone 504*a* is extended via the dip tube 504 dipping permanently down into the liquid to be dispensed, contained in the container 524. The tube 504 has an axis of symmetry W.

The axis W is parallel to the axes X and Y, and orthogonal to the axis Z. It is interesting to note that the axes W, X, Y and Z are situated in one and the same plane (that of FIG. 1).

The operation of the precompression pump 501 according to the invention is as follows: at rest, the pump is in the position represented in FIG. 1, the body 503 containing air, and the liquid being located in the container 524.

The user has first of all to prime the pump, that is to say to fill the body 503 with liquid, this operation driving out the air. To do this, he or she has to press once or twice on the operating member 506. During this operation, the air trapped in the body 503 is compressed. In the bottom position, the surface 506*b* of the operating member 506 comes to bear against the stud 510*d* of the second piston 510, and this results in the latter moving downwards, thus freeing the passage 550 via which the compressed air may escape, via the dispensing channel 518 and the nozzle 520.

When the user stops pressing on the operating member 506, the spring 509 causes the piston 507 to rise back up. As a consequence, a partial vacuum is created in the body 503, which also causes the non-return valve 504*a*, 515 to open, that is to say causes a movement of the ball 515 and causes a certain amount of liquid to rise up into the body 503. From this moment, when the body 503 is full of liquid, pushing in the piston 507 causes a rapid rise in pressure in the body 503. Next, the precompression member 510 moves, the frustoconical projection 551 thus freeing the passage 550 via which the liquid is conveyed towards the spray orifice 521 where good quality spraying of the liquid takes place by virtue of the short distance to be covered in the dispensing channel 518.

As the liquid is dispensed, a partial vacuum is set up in the container 524. In order to be able to replace with air the volume of liquid dispensed, the orifice 505*a* emerging to the outside may be placed in communication with the container 524 via the precompression chamber and the capillary channel 523*a*. In the position of rest which corresponds to the high position of the precompression piston 510, no communication is possible, that is to say that the precompression chamber 505 does not communicate with the dispensing channel 518, owing to the presence of the lip 510*a*, and the air intake orifice 505*a* does not communicate with the container 524 because the lip 510*e* provides sealing. When the precompression piston 510 descends, following actuation of the operating member 506, the lip 510*e* slides into a region 523*b* where the precompression chamber has a larger cross-section, and where the seal between the lip 510*e* and the internal wall 505*b* of the chamber 505 is broken, and the air coming from the orifice 505*a* may penetrate the container 524, thus placing it at atmospheric pressure.

Figure 2:
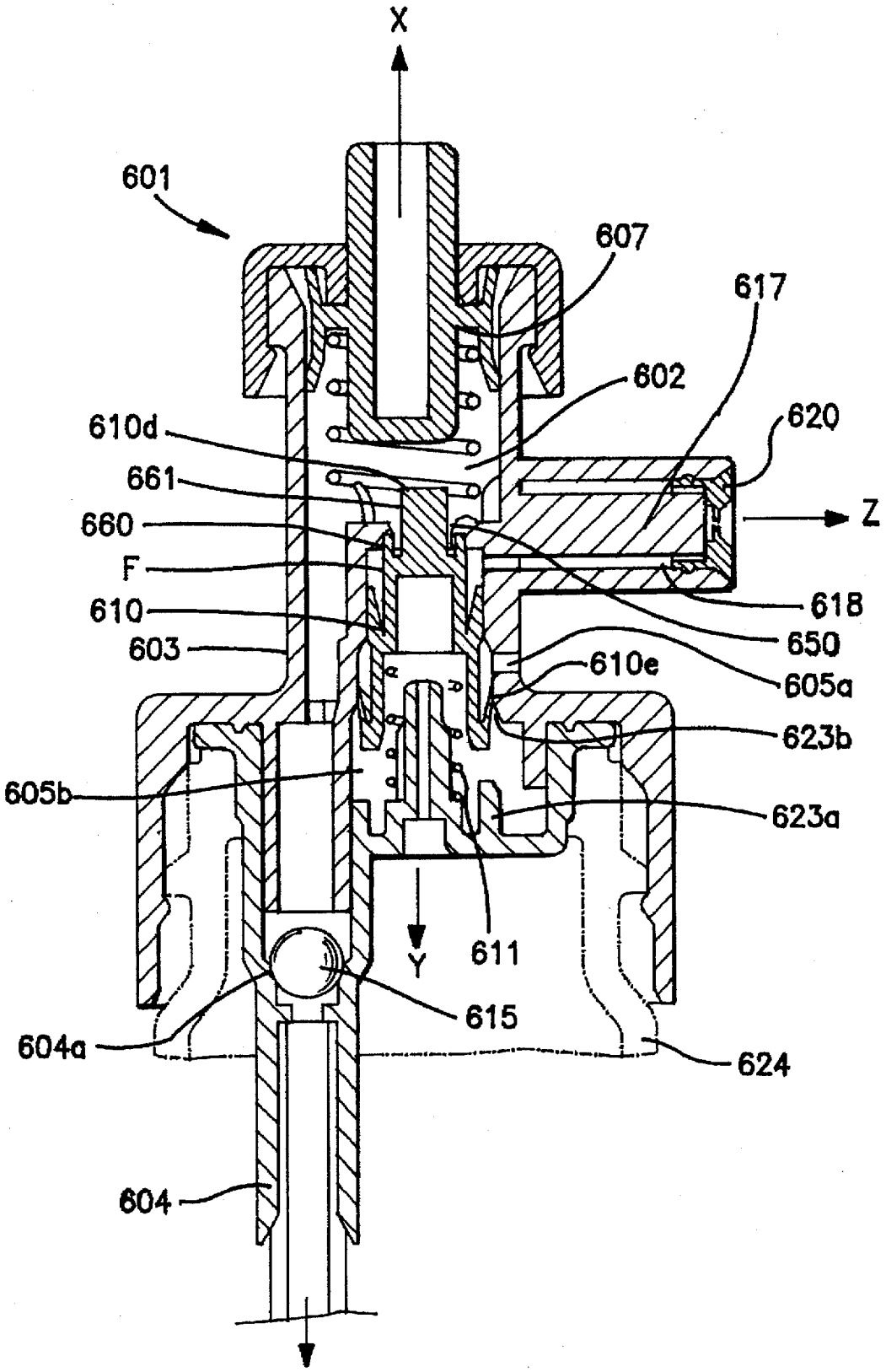
FIG. 2 shows a second embodiment of the invention.

Referring to FIG. 2, a second embodiment of a precompression pump according to the invention has been represented. In this figure, the constituent parts bear the reference numerals of the parts which are the same as or fulfil a role similar to those of FIG. 1, increased by 100. The arrangements which are identical to those of FIG. 1 will be described again only partly.

In the pump 601 according to FIG. 2, only the sliding means F for placing in communication and for closure is different, but fulfils a role identical to the one described in FIG. 1.

Thus, the precompression member includes a piston 610, of which the end 610*b* turned towards the pumping chamber 602 bears an annular sealing ring 660 interacting with a complementary annular groove 651 made around a passage 650; this ring 660, in the position of rest of the pump, closes the passage 650 between the pumping chamber 602 and the precompression chamber 605. The piston 610 is mounted on a spring 611 which, in the position of rest, provides elastic closure of the means F for placing in communication and for closure. The spring 611 is held in place by a cup 640 of identical construction to that of the pump shown in FIG. 1.

The operation of this device is the same as that described with reference to FIG. 1.

We claim:

1. A precompression pump (501, 601) for spraying a liquid under constant pressure, comprising:

a cylindrical body (503, 603) defining a cylindrical pumping chamber (502, 602) having a longitudinal axis (X) and in which is housed a first piston (507, 607) associated with an operating member (506, 606), said first piston bearing against a first elastic return means (509, 609);

a cylindrical precompression chamber (505, 605) having a longitudinal axis (Y) and being equipped with a second piston (510, 610) bearing against a second elastic return means (511, 611), the precompression chamber being in fluid communication with the pumping chamber (502, 602) via a passage (550, 650);

a feed channel (504, 604) equipped with a non-return valve (515, 504*a*; 615, 604*a*) emerging in the pumping chamber (502, 602); and a dispensing element (517, 617) equipped with a spray nozzle (520, 620) and with a dispensing channel (518, 618) connecting the nozzle to the precompression chamber, said second piston (510, 610) comprising a sliding means (F) for opening and for closing said passage (550, 650) so that fluid communication between said precompression chamber and said pumping chamber is interrupted in the position of rest of the pump and so that this fluid communication is established upon precompression under the action of the operating member; the improvement wherein the longitudinal axis (Y) of the precompression chamber (505, 605) is parallel but spaced from the longitudinal axis (X) of the pumping chamber (502, 602), the precompression chamber (505, 605) being situated in an extension of the pumping chamber (502, 602); and the liquid contained in the pumping chamber (502, 602) gaining direct access to the precompression chamber (505, 605) upon actuation of the operating means (506, 606).

2. The precompression pump according to claim 1, characterized in that the nozzle (520, 620) is stationary with respect to the body (503, 603) of the pump.

3. The precompression pump according to claim 1, characterized in that the spray nozzle (520, 620) is equipped with a spray orifice (521, 621) directed along an axis (Z) substantially orthogonal to the longitudinal axis (X).

4. The precompression pump according to claim 1, characterized in that the sliding means (F) comprises an annular sealing ring (660) firmly secured to the second piston (610) and bearing against an edge or peripheral groove (651) of the passage (650), capable of closing off the passage.

5. The precompression pump according to claim 1, characterized in that the sliding means (F) comprises a projection (551) formed at the top of the second piston (510) facing the first piston (507) and which is capable of closing off said passage (550).

6. The precompression pump according to claim 3, characterized in that the axes (X), (Y) and (Z) are situated in one and the same plane.

7. The precompression pump according to claim 1, characterized in that the first elastic return means (509, 609) comprises a helical spring.

8. The precompression pump according to claim 1, characterized in that the second elastic return means (511, 611) comprises a helical spring.

9. The precompression pump according to claim 1, characterized in that the non-return valve includes a spherical ball (515, 615) housed in a frustoconical portion (504*a*, 604*a*) of the feed channel (504, 604).

10. The precompression pump, according to claim 1, characterized in that the precompression chamber (505, 605) includes a capillary channel (523*a*, 623*a*) placing this precompression chamber and a container (524, 624) containing the liquid to be dispensed in fluid communication.

11. The precompression pump according to claim 1, characterized in that the precompression chamber (505, 605) is equipped with a means (505*a*, 523*a*; 605*a*, 623*a*) for venting to atmosphere.

12. The precompression pump according to claim 11, characterized in that the means (505*a*, 523*a*; 605*a*, 623*a*) for venting to atmosphere comprises an air intake orifice (505*a*, 605*a*), a fluid passageway (523*a*, 623*a*) between the precompression chamber (505, 605) and the container (524, 624), and a sealing means (510*e*, 610*e*) firmly attached to the second piston (510, 610), this sealing means being operative in the position of rest of the pump and inoperative in the actuating position.

13. The precompression pump according to claim 12, characterized in that the sealing means (510*e*, 610*e*) is an annular lip in sealing contact with the cylindrical wall of the precompression chamber in the position of rest of the pump, and freeing an air intake passage (523*b*, 623*b*) upon actuation of the pump.

14. The precompression pump according to claim 1, characterized by a means facilitating priming of the pump upon first use, located between the first piston (507, 607) and the second piston (510, 610).

15. The precompression pump according to claim 14, characterized in that the means facilitating priming of the pump is a central stud (510*d*, 610*d*) situated at the top of the second piston (510, 610), this stud coming to bear against the first piston (507, 607) when the latter is in a position in which the volume of the pumping chamber (502, 602) is at a minimum.

16. The precompression pump of claim 1, in an assembly for dispensing a liquid in the form of droplets, including a container (524, 624) for the liquid to be dispensed.

17. The precompression pump of claim 16, further comprising means (516, 616) for fixing the pump onto the container (524, 624).

18. The precompression pump of claim 16, further comprising a lever arm for actuating operating member (506, 606).

19. The precompression pump according to claim 1, characterized in that said feed channel (504, 604) has a longitudinal axis (W) that is parallel to but spaced from said longitudinal axis (Y) of the precompression chamber (505, 605) and said longitudinal axis (X) of the pumping chamber (502, 602).

20. The precompression pump according to claim 19, wherein the said axis (X) of the pumping chamber (502, 602) is disposed between said axis (Y) of the precompression chamber (502, 605) and said axis (X) of the pumping chamber (502, 602).

* * * * *